US005401123A

United States Patent [19]

Kobow et al.

[11] Patent Number: 5,401,123

[45] Date of Patent: Mar. 28, 1995

[54] CONTROL DEVICE FOR MINE-ROOF SUPPORT

[75] Inventors: Wolfgang Kobow, Wuppertal; Werner Reinelt, Bochum, both of Germany

[73] Assignee: Hermann Hemscheidt Maschinenfabrik GmbH & Co., Wuppertal, Germany

[21] Appl. No.: 169,027

[22] Filed: Dec. 20, 1993

[30] Foreign Application Priority Data

Dec. 21, 1992 [DE] Germany ..... 42 43 289.8

[51] Int. Cl.[6] ..... E21D 23/16

[52] U.S. Cl. ..... 405/302; 405/296; 91/170 MP

[58] Field of Search ..... 405/291, 296, 299, 302; 91/170 MP, 508, 520, 530; 299/33

[56] References Cited

U.S. PATENT DOCUMENTS 4,225,271 9/1980 Nerlich ..... 405/302
4,247,226 1/1981 Weirich ..... 405/302
4,657,443 4/1987 Blumenthal ..... 405/302
4,692,067 9/1987 Ward et al. ..... 405/302

FOREIGN PATENT DOCUMENTS 2807431 8/1979 Germany .

*Primary Examiner*—David H. Corbin
*Attorney, Agent, or Firm*—Keck, Mahin & Cate

[57] ABSTRACT

The control device is adapted to be inserted between the control valves of a pilot device and the pressure-medium consumers (hydraulic prop and hydraulic working cylinder) in an hydraulic self-advancing mine-roof support and is connected to a pressure-medium line and to a return line. The control device comprises a valve block with continuous longitudinal bores for connection to a multiple tubing line leading to the pilot device, the valve block having bores for receiving piloted 3/2-way valves and bores for connection to the directly-controlled working cylinders of the mine-roof support.

6 Claims, 2 Drawing Sheets

P
T
$P_N$
1
2
3
4
5
6
7
8
9
10
11
12
13
14
15
16
17
18
20

CONTROL DEVICE FOR MINE-ROOF SUPPORT

FIELD OF THE INVENTION

The invention relates to a control device for an hydraulic self-advancing mine-roof support, the control device being provided with connections for a pressure-medium line, for a return line, and for the pressure-medium consumers of the support, and being connected by a multiple tubing line to series-connected control valves of a pilot device. The pressure-medium consumer(s) of the support which use only a small amount of pressure medium per unit time is or are directly actuated by the control valves of the pilot device via the multiple tubing line whereas the pressure-medium consumer(s) of the support which use a large amount of pressure medium are indirectly supplied with pressure medium via piloted directional-control valves for actuation by the control valves via the multiple tubing line.

DESCRIPTION OF PRIOR ART

DE 28 07 431 C2 discloses a control device for hydraulic self-advancing mine-roof supports which is actuated by the control valves of a pilot device in an adjacent mine-roof support. A multiple tubing line, in which the passages of a number of individual lines are combined to form a bunch of tubes, connects the pilot device to a distribution unit disposed in the mine-roof support to be controlled. The pressure-medium consumers in the mine-roof support (e.g. an hydraulic prop and an hydraulic working cylinder) fulfil various functions and therefore need various amounts of pressure medium, depending on the effective piston area in the respective hydraulic cylinders. The props in the support have considerably larger piston areas than, for example, the actuating or working cylinders which stabilise the joint between the roof beam and the fracture shield and which need only a small amount of pressure medium per unit time. Consequently, the pressure-medium consumers needing only a small amount of pressure medium are directly actuated, in that the pressure medium from the control valve of the pilot device flows through the distribution unit directly into the cylinder space of the connected pressure-medium consumer. The pressure-medium consumers needing a large amount of pressure medium are supplied via piloted direct control valves incorporated in an additional valve block alongside the distributor. The piloted directional control valves are likewise actuated, via the multiple tubing line, by the control valves in the pilot device.

Owing to the very large number of individual bores of varying diameters and extending in various directions, the valve block and the distribution unit are constructed as separate modular units which are connected to one another. Consequently there are numerous sealing places between the modular units. The result is a bulky sub-assembly which is difficult to incorporate in a mine-roof support where space is often very limited. Another requirement is an easily-surveyable efficient layout of tubing for the individual incoming and outgoing hydraulic pipes. In particular, the tubing must not be squeezed or bent when a mine-roof support is lowered.

AIM OF THE INVENTION

The aim of the present invention therefore is to construct a compact control device with an easily-surveyable layout of the tubing for direct and indirect supply of pressure medium, the control device being inexpensive to make and containing the piloted directional-control valves and the line distribution means.

BROAD STATEMENT OF THE INVENTION

To this end, according to the invention, the multiple tubing line is connected to a valve block in which the piloted directional-control valves are disposed, the pressure-medium consumer(s) of a mine-roof support needing a small amount of pressure medium being directly connected to the associated connections of the multiple tubing line via bores extending through the valve block.

Advantageous other features of the invention are disclosed in the dependent claims.

The control device according to the invention combines the distributor, the valve block and the piloted directional-control valves in a single structure, thus eliminating the seals and securing elements hitherto required between separate structural units. The control device comprises a small compact valve block with a very advantageous distribution and arrangement of the numerous bores for holding the directional-control valves and for distributing the pressure medium from the control valves in the pilot device to the pressure-medium consumers in the self-advancing mine-roof support. The result is that the tubing is easily surveyable—all plug-in connections are in two rows on one longitudinal side of the valve block—and the cartridges of the piloted directional-control valves are easily accessible on the opposite longitudinal side. In addition, the valve block can be inexpensively manufactured by program-controlled machine tools.

DESCRIPTION OF PARTICULAR EMBODIMENT

An example of a control device in accordance with the invention will now be explained in detail with reference to the accompanying drawings, in which.

Figure 1:
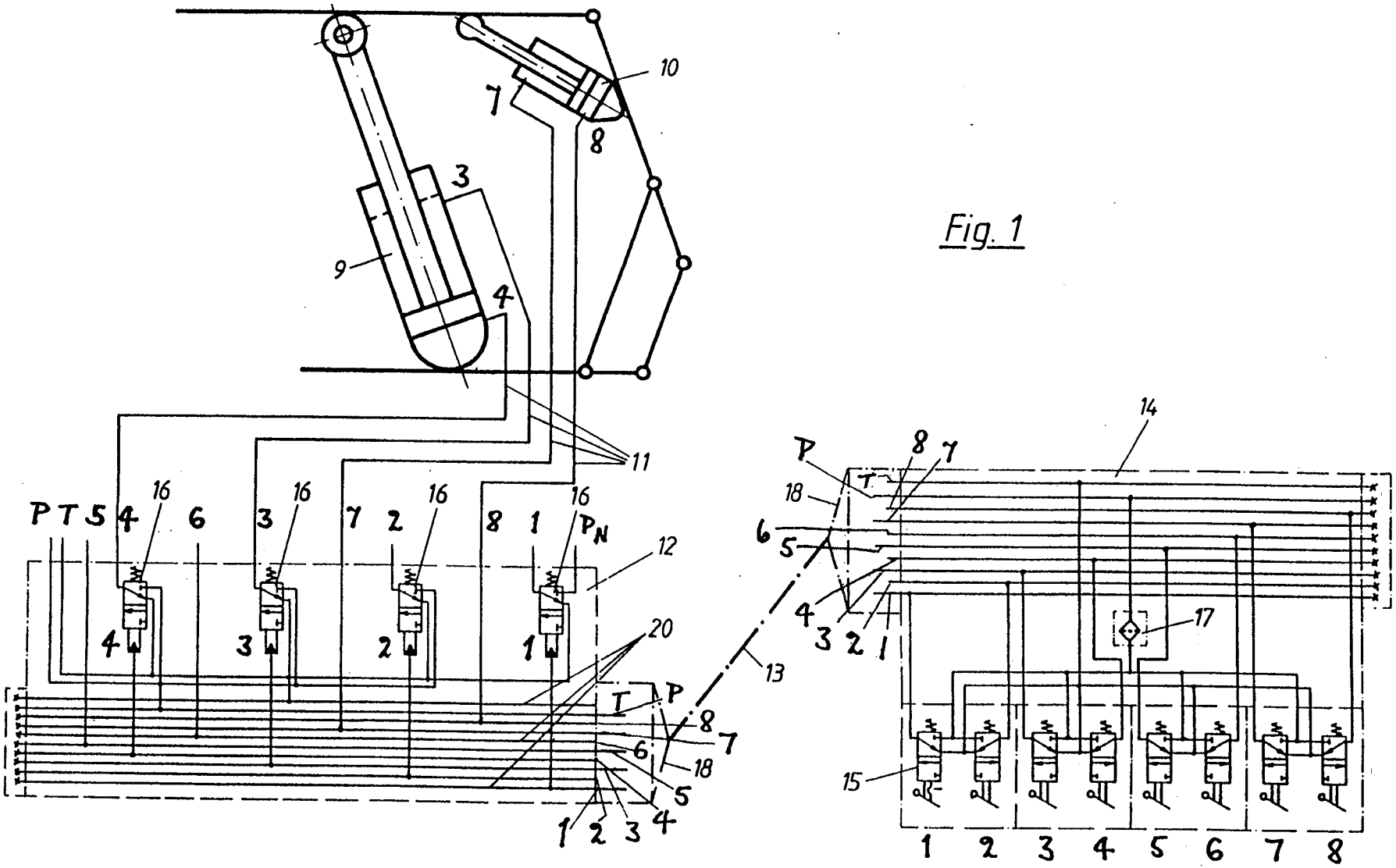
FIG. 1 shows the arrangement and connections between a self-advancing mine-roof support, the control device and the pilot device.
Figure 2:
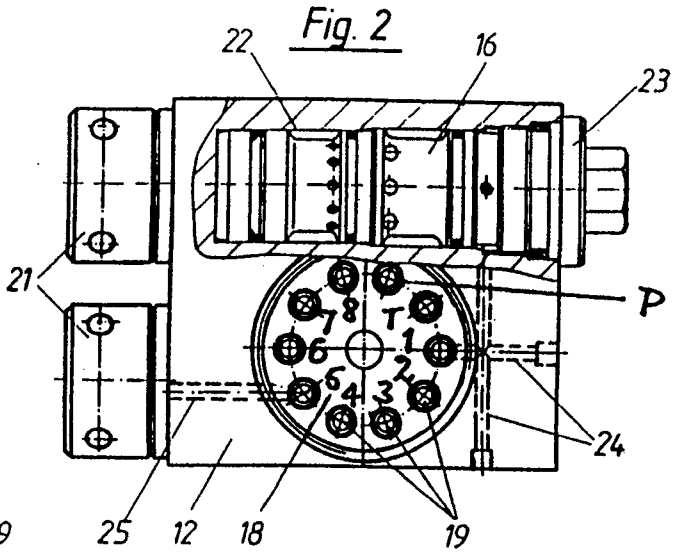
FIG. 2 is an end view of the control device, partly in section.
Figure 3:
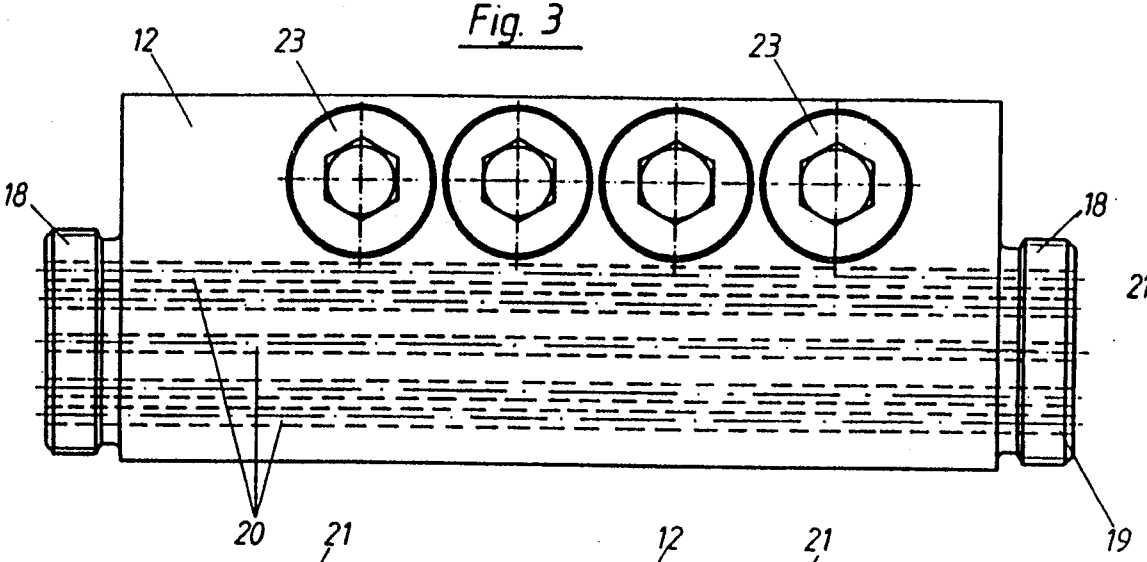
FIG. 3 shows a long side of the control device, with the receiving bores.

The illustrated control device is designed for eight functions 1 to 8. The hydraulic cylinders of a mine-roof support are shown diagrammatically in FIG. 1. These comprise a double-acting hydraulic prop 9 having a large piston area and a correspondingly-large consumption of pressure medium per unit time, and a double-acting hydraulic corner cylinder 10—for stabilising the connecting joint between the fracture shield and the roof beam—which consumes a comparatively small amount of pressure-medium per unit time.

Functions 1 and 2 are allocated to a pushing or advancing ram (not shown) forming part of the mine-roof support. Functions 3 and 4 belong to the prop 9. An additional working cylinder (not shown) needing a small amount of pressure medium per unit time is controlled via functions 5 and 6. The corner cylinder 10 is supplied with pressure medium via functions 7 and 8.

The cylinder spaces of the prop 9 and of the corner cylinder 10 are connected by individual tubing lines 11 to the valve block 12. The valve block is connected by a 10-passage multiple tubing line 13 to a pilot device 14 which receives the control valves 15 for triggering the functions 1 to 8 of the stope support. In FIG. 1, only one of the eight control valves 15 is denoted by a reference numeral.

The pressure medium is supplied to the valve block 12 through the line P. Another connection is provided for the return line T. The pressure medium is conveyed to the 3/2-way valve 16 disposed in the valve block 12 and assigned to the functions 2, 3 and 4. The 3/2-way valve 16 for the function 1 (to withdraw a conveyor) is supplied with pressure medium at a reduced pressure through a separate line $P_N$. The valve block 12 conveys the pressure medium through a passage in the multiple line 13 to the pilot device 14. Another passage in the multiple line 13 connects the return connection of the pilot device 14 to the return line T connected to the valve block 12. In the pilot device 14, the pressure medium from the pressure-medium connection is conveyed through a filter 17 to the individual control valves 15, which are likewise connected to the return line T.

When the control valves 15 are actuated, pressure medium flows through the passages of the multiple line 13 to the valve block 12. If, for example, the control lever of the control valve 15 is pressed by function 8, then the pressure medium flows from the pilot device 14 through the multiple line 13 into the valve block 12 and thence via the individual tubing line 11 assigned to function 8 to the piston surface of the corner cylinder 10. The latter is thereby extended.

The extension of the prop 9 is initiated by the control valve 15 via function 4. From there, the pressure medium flows to the control piston (not shown) of the 3/2-way valve 16 concerned with function 4. The required pressure medium is conveyed by the actuated, switched-on 3/2-way valve 16 from the pressure-medium line P connected to the valve block 12 to the piston of the prop 9. In this manner, all consumers using a large amount of pressure medium (functions 1 to 4) are indirectly supplied therewith via the piloted directional-control valves 16.

The multiple tubing line 13 is connected to one of the two connecting heads 18 disposed on the valve block 12. Groups of ten connecting bores 19, corresponding to the number of passages in the multiple line 13, are disposed in the connecting heads 18. Longitudinal bores 20 extend from the connecting bores 19 and are guided through the valve block 12 so as to interconnect the connecting bores 19 in the opposite connecting head 18. Only one connecting head 18 is connected to a multiple tubing line 13 at a time, the connecting head 18 on the opposite side of the valve block 12 being sealed in a pressure-tight manner.

Figure 4:
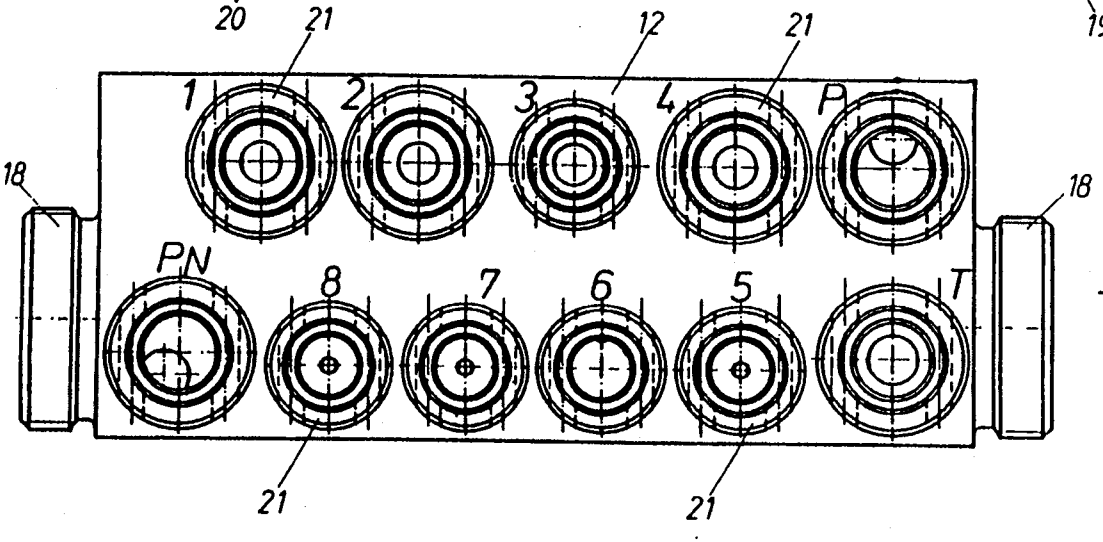
FIG. 4 shows a long side of the control device, with the plug-in connections.

On the longitudinal side of the valve block 12 shown in FIG. 4 there are two superposed rows of five and six plug-in connections 21 respectively for the pressure-medium lines P and $P_N$, the return line T and the individual tubing lines 11. The plug-in connections 21 in the top row—which are partly offset to some extent—open directly into bores 22 behind them for receiving the piloted 3/2-way valves 16 which are in the form of valve cartridges, the valves being connected to the pressure-medium line P and supplying the consumers using a large amount of pressure medium per unit time, e.g. the props 9.

The receiving bores 22, which are externally covered by closure screws 23, extend from the opposite longitudinal side of the valve block 12 and are disposed at right angles to the longitudinal bores 20 below them and connected thereto along a short distance via respective tap bores 24. Additional tap bores 25 extend from the plug-in connections 21 in the bottom row and open into the associated longitudinal bores 20, either directly or indirectly via short transverse bores not shown in the drawings, and are therefore available for direct flow of the pressure medium from the piloting device 14 to the pressure-medium consumers needing a small amount of pressure fluid, i.e. for functions 5 to 8 in the valve block 12.

We claim:

1. A control device for an hydraulic self-advancing mine-roof support, comprising a connection for a pressure-medium line, a connection for a return line, and connections for pressure-medium consumers of the mine-roof support, the pressure-medium consumers including at least one consumer using a small amount of pressure medium per unit time and at least one consumer using a large amount of pressure medium, wherein a multiple tubing line connects the control device to piloted control valves of a pilot device whereby the pressure-medium consumer(s) using a small amount of pressure medium per unit time is directly actuated by the control valves of the pilot device via the multiple tubing line whereas the pressure-medium consumer(s) using a large amount of pressure medium is indirectly supplied with pressure medium via piloted directional-control valves for actuation by the control valves via the multiple tubing line, the multiple tubing line being connected to a valve block in which the piloted directional-control valves are disposed, and the pressure-medium consumer(s) needing a small amount of pressure medium being directly connected to the associated connections of the multiple tubing line via bores extending through the valve block.

2. A control device according to claim 1 which comprises a valve block provided at end faces thereof with connecting heads for receiving plug nipples of the multiple tubing line and provided at one longitudinal side with two rows of superposed plug-in connections for pressure-medium lines, for the return line, and for the individual tubing lines leading to the pressure-medium consumers in the mine-roof support.

3. A control device according to claim 2, wherein the nipples of the multiple tubing line open into longitudinal bores extending from one connecting head to the other connecting head through the valve block, and wherein the bores for receiving the piloted directional-control valves are disposed in a plane above and are offset at right angles to the longitudinal bores.

4. A control device according to claim 2, wherein the bores extending through the valve block are disposed in the same plane as the plug-in connections for the pressure-medium consumer(s) using a small amount of pressure medium per unit time and are each connected thereto by short tap bores.

5. A control device according to claim 2, wherein the connecting bores for the piloted directional-control valves are connected by short tap bores to the associated longitudinal bores and are disposed in the same plane as, and open into, the plug-in connections for the pressure-medium consumer(s) needing a large amount of pressure medium.

6. A control device according to claim 1, wherein the piloted directional control valves are in the form of valve cartridges.

* * * * *